US008894478B1

(12) United States Patent
Stillwagon

(10) Patent No.: US 8,894,478 B1
(45) Date of Patent: Nov. 25, 2014

(54) ENVIRONMENTAL IMPROVEMENT SYSTEM

(76) Inventor: Woodrow Stillwagon, Greenville, SC (US)

( * ) Notice: Subject to any disclaimer, the term of this patent is extended or adjusted under 35 U.S.C. 154(b) by 0 days.

(21) Appl. No.: 13/599,439

(22) Filed: Aug. 30, 2012

Related U.S. Application Data

(60) Provisional application No. 61/631,522, filed on Jan. 6, 2012.

(51) Int. Cl.
*F24F 7/06* (2006.01)
*F24F 7/007* (2006.01)

(52) U.S. Cl.
USPC ..... 454/249; 454/231

(58) Field of Classification Search
CPC ..... F24F 7/065; F24F 3/044; F24F 3/16; F24F 6/02; F24D 5/00
USPC ..... 454/231, 249
See application file for complete search history.

(56) References Cited

U.S. PATENT DOCUMENTS 1,409,364 A * 3/1922 Dobbs et al. ..... 422/124
1,958,768 A * 5/1934 Ross ..... 55/472
2,679,202 A * 5/1954 Koff ..... 454/269
3,347,025 A * 10/1967 Wiley ..... 96/224
3,827,342 A * 8/1974 Hughes ..... 454/231
3,973,479 A * 8/1976 Whiteley ..... 454/231
4,053,732 A * 10/1977 Carter ..... 392/358
4,136,606 A * 1/1979 Wolbrink ..... 454/231
4,152,973 A * 5/1979 Peterson ..... 454/231
4,184,415 A * 1/1980 Nicholson ..... 454/231
4,185,545 A * 1/1980 Rusth et al. ..... 454/231
4,249,463 A * 2/1981 Hornby ..... 454/57
4,344,112 A * 8/1982 Brown ..... 362/96
4,403,732 A * 9/1983 Primich ..... 237/50
4,738,188 A * 4/1988 Nishida ..... 454/229
4,945,820 A * 8/1990 Fukuda ..... 454/231
4,950,871 A * 8/1990 Pollak et al. ..... 392/375
5,042,366 A * 8/1991 Panetski et al. ..... 454/231
5,078,574 A * 1/1992 Olsen ..... 415/182.1
5,230,719 A * 7/1993 Berner et al. ..... 96/144
5,236,393 A * 8/1993 Milewski ..... 454/266
5,941,767 A * 8/1999 Fukuda ..... 454/230
6,009,763 A * 1/2000 Berckmans et al. ..... 73/861.79
6,241,600 B1 * 6/2001 Uehara ..... 454/252
6,267,924 B1 7/2001 Fencl et al.
6,322,614 B1 * 11/2001 Tillmans ..... 96/16
6,363,951 B1 4/2002 Wood (Continued)

*Primary Examiner* — Steven B McCallister
*Assistant Examiner* — Jonathan Cotov
(74) *Attorney, Agent, or Firm* — Smith Moore Leatherwood LLP; Thomas W. Epting; John P. Zimmer

(57) ABSTRACT

An environmental improvement system for placement within a room bounded by a floor and a ceiling is provided herein. In one embodiment, the system comprises a duct system that extends through the open volume of the room from the floor to the ceiling. The duct system comprises a base unit at a first end terminating proximate the floor, a support unit at a second end terminating proximate the ceiling, and a duct connecting the base and support units. The base unit defines a first opening, and the support unit defines a second opening. At least one fan is disposed between the first and second openings and draws air from the room into and through the system and discharges the air from the system. The first and second openings are each adapted to selectively act as an intake opening or as a discharge opening.

20 Claims, 5 Drawing Sheets

(56) References Cited

U.S. PATENT DOCUMENTS

| | | | | |
|---|---|---|---|---|
| 6,375,714 | B1 | 4/2002 | Rump et al. | |
| 6,500,267 | B1 | 12/2002 | Fencl et al. | |
| 6,528,022 | B1 | 3/2003 | Kinoshita | |
| 6,627,000 | B2 | 9/2003 | Fencl et al. | |
| 6,678,486 | B2 | 1/2004 | Amering et al. | |
| 6,869,468 | B2 | 3/2005 | Gibson | |
| 6,938,683 | B2 * | 9/2005 | Lin | 165/121 |
| 6,955,708 | B1 | 10/2005 | Julos et al. | |
| 6,984,259 | B2 | 1/2006 | Hurst | |
| 7,028,685 | B1 | 4/2006 | Krecke | |
| 7,332,006 | B2 | 2/2008 | Kim et al. | |
| 7,332,096 | B2 | 2/2008 | Blickhan | |
| 7,381,129 | B2 * | 6/2008 | Avedon | 454/230 |
| 7,407,613 | B2 | 8/2008 | Ferderer | |
| 7,419,533 | B2 | 9/2008 | Son et al. | |
| 7,421,851 | B2 | 9/2008 | Witham et al. | |
| 7,431,752 | B2 | 10/2008 | Liang | |
| 7,441,588 | B2 | 10/2008 | Matsugi et al. | |
| 7,473,304 | B2 | 1/2009 | Besi | |
| 7,597,856 | B2 | 10/2009 | Naarup | |
| 7,704,463 | B2 | 4/2010 | Willette | |
| 7,740,686 | B2 | 6/2010 | Metteer | |
| 7,763,212 | B2 | 7/2010 | McEllen | |
| 7,771,672 | B2 | 8/2010 | Bergeron et al. | |
| 7,797,885 | B2 | 9/2010 | Mower et al. | |
| 7,841,929 | B2 | 11/2010 | Spiegel et al. | |
| 7,879,299 | B2 | 2/2011 | McEllen | |
| 7,892,306 | B2 | 2/2011 | Kummer et al. | |
| 7,916,015 | B1 | 3/2011 | Evancich et al. | |
| 7,971,634 | B2 | 7/2011 | Hara et al. | |
| 8,003,958 | B2 | 8/2011 | Yamazaki et al. | |
| 8,032,254 | B2 | 10/2011 | Amundson et al. | |
| 8,080,203 | B2 | 12/2011 | First et al. | |
| 2007/0145291 | A1 * | 6/2007 | Avnery | 250/453.11 |
| 2007/0293141 | A1 * | 12/2007 | Sims | 454/349 |
| 2010/0323604 | A1 * | 12/2010 | Duffe | 454/258 |
| 2011/0021133 | A1 | 1/2011 | Zwern | |
| 2011/0042945 | A1 | 2/2011 | Coughenour et al. | |
| 2011/0083757 | A1 | 4/2011 | Shore et al. | |
| 2011/0120314 | A1 | 5/2011 | Magner et al. | |
| 2011/0142725 | A1 | 6/2011 | Liu et al. | |
| 2011/0143646 | A1 * | 6/2011 | Van Der Kooij | 454/237 |
| 2011/0200655 | A1 | 8/2011 | Black et al. | |
| 2011/0218600 | A1 | 9/2011 | Kamen et al. | |
| 2011/0274588 | A1 | 11/2011 | Bergeron et al. | |
| 2011/0275735 | A1 | 11/2011 | Robbins et al. | |
| 2012/0001991 | A1 | 1/2012 | Onozawa et al. | |
| 2012/0018123 | A1 | 1/2012 | Sheren | |
| 2012/0020832 | A1 | 1/2012 | St. Onge et al. | |

* cited by examiner

ENVIRONMENTAL IMPROVEMENT SYSTEM

CROSS REFERENCE TO RELATED APPLICATION

This invention claims priority pursuant to 35 U.S.C. §119 (e) to U.S. Provisional Patent Application Ser. No. 61/631,522, filed on Jan. 6, 2012, which is hereby incorporated by reference in its entirety.

BACKGROUND

This invention relates generally to an energy conservation and environmental improvement system which may be used to circulate, purify, and freshen air.

It is commonly known that warm air rises and cool air sinks. Therefore, a room or space that is being heated may have air that is warmer near the ceiling than near the floor. Conversely, a room being cooled may have cooler air near the floor than near the ceiling. Due to this phenomenon, air thermostat settings may be adjusted seasonally to achieve a comfortable temperature at approximately the head height, or eye-level, of the occupants. Consequently, depending upon the ceiling height of a particular room or space, the extra energy needed to maintain comfort at approximately the eye-level of occupants can potentially add 5-10% or more to heating and cooling costs.

Buildings having large-volume spaces and/or high ceilings frequently also exhibit significant vertical air temperature distributions over multiple different, generally isothermal, strata or layers of air, with higher layers including warmer air and lower layers including cooler air.

Also potentially affecting the environmental quality of air are airborne bacteria, viruses, fungi, dust, and other contaminants. An epidemiology study by Pennsylvania State University showed that 81% of airborne illness may be contracted in buildings having large volume living areas, such as schools, hospitals, shopping malls, bars, restaurants, churches, theaters, box stores and offices.

Accordingly, it may be desirable to provide an environmental improvement system capable of achieving comfortable eye-level air temperature substantially year-round with reduced cost and improved air quality. It may be further desirable to improve the quality of air by lessoning the contaminant level thereof and/or by providing a fragrance to the air.

SUMMARY

Generally, in one embodiment of the present invention, an environmental improvement system is provided for facilitating comfortable eye-level temperature year-round with reduced cost. In addition, an embodiment of the present invention can provide air purification as well. Further, an embodiment of the present invention can emit a fragrance that freshens the smell of air or diminishes odors in the air such as those associated with smoking, rigorous athletic activities, musty furniture, or restaurants. Generally, one embodiment of the present invention may include an environmental improvement system for placement within a room bounded by a floor and a ceiling and having an open volume from the floor to the ceiling. The environmental improvement system comprises a duct system that extends through the open volume of the room substantially from the floor of the room to the ceiling of the room. The duct system comprises a base unit at a first end of the duct system terminating proximate the floor of the room and a support unit at a second end of the duct system terminating proximate the ceiling of the room. The duct system base unit defines a first opening at the first end, and the duct system support unit defines a second opening at the second end. A duct connects the base unit to the support unit. At least one fan, which may be reversible, is disposed in the duct system between the first opening and the second opening. The fan draws air from the room into the duct system, through the duct, and discharges the air from the duct system. The first opening is adapted to selectively act as a first intake opening through which the air is drawn into the duct system by the fan or as a first discharge opening through which the air is discharged from the duct system. The second opening is adapted to selectively act as a second intake opening through which the air is drawn into the duct system by the fan or as a second discharge opening through which the air is discharged from the duct system. Thus, either the first opening or the second opening can be used as the point of entry for the air, as desired by the user. The opening not used as the point of entry can be used as the point of discharge. Additionally, at least two fans may be provided which are substantially synchronized to each deliver substantially the same volumetric airflow with respect to one another.

In this way, an environmental improvement system described herein can be used to selectively convey air from the floor region of a room to the ceiling region of the room or from the ceiling region of a room to the floor region of the room, as desired by the user.

These and other embodiments are described in greater detail in the description which follows.

BRIEF DESCRIPTION OF THE DRAWINGS

The drawings referenced herein form a part of the specification. Features shown in the drawings are meant as illustrative of some, but not all, embodiments of the invention, unless otherwise explicitly indicated, and implications to the contrary are otherwise not to be made. Although in the drawings like reference numerals correspond to similar, though not necessarily identical, components and/or features, for the sake of brevity, reference numerals or features having a previously described function may not necessarily be described in connection with other drawings in which such components and/or features appear.

DESCRIPTION OF THE PREFERRED EMBODIMENTS

Figure 1:
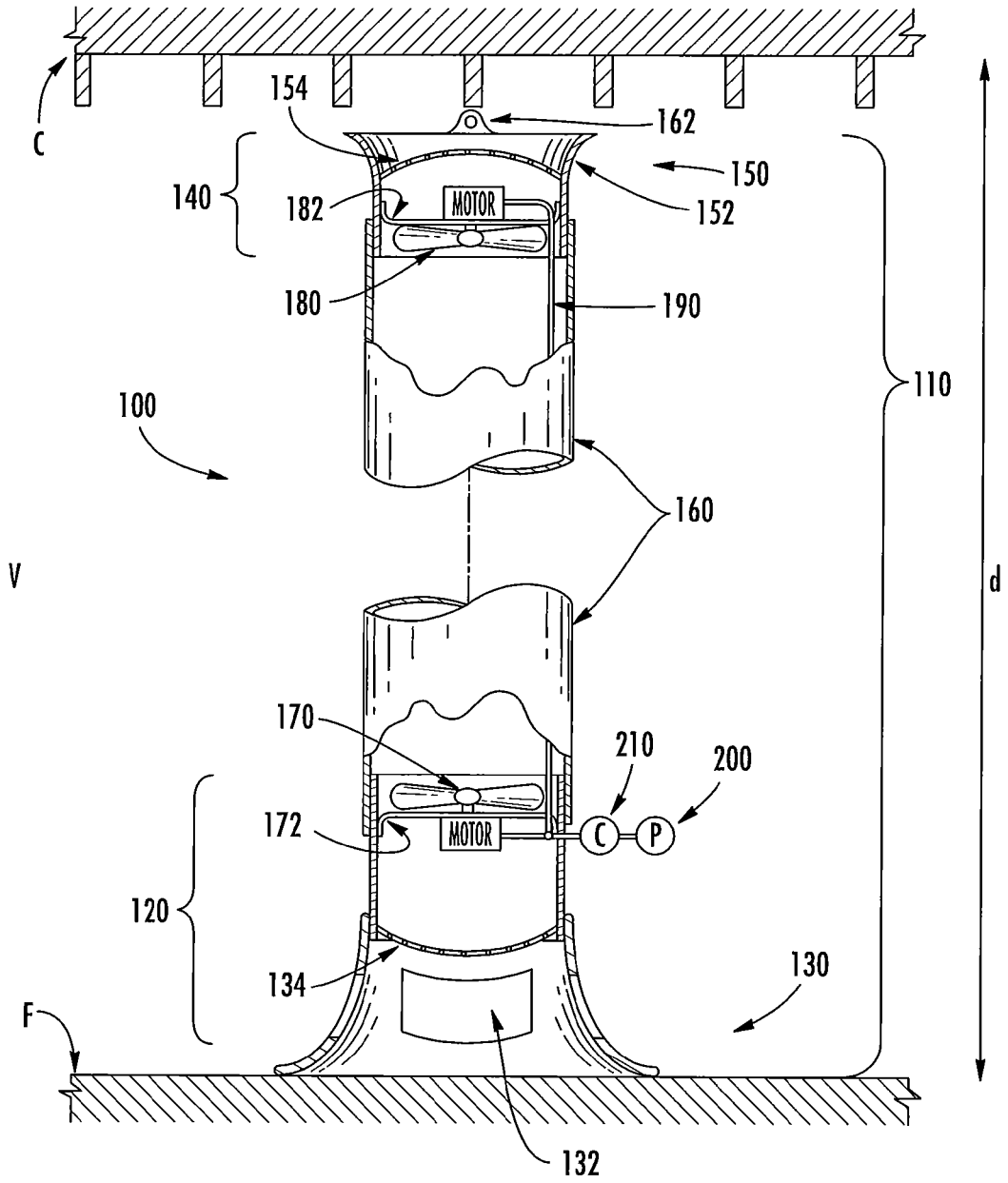
FIG. 1 is a perspective view, with parts cut away, of an environmental improvement system constructed in accordance with the present invention, illustrating the use of two synchronized push-pull fans.

In the following detailed description of representative embodiments of the invention, reference is made to the accompanying drawings that form a part hereof, and in which are shown by way of illustration specific examples of embodiments in which the invention may be practiced. While these embodiments are described in sufficient detail to enable those skilled in the art to practice the invention, it will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure. Specifically, other embodiments may be utilized, and logical, mechanical, electrical, material, and other changes may be made without departing from the spirit or scope of the present invention.

Accordingly, the following detailed description is not to be taken in a limiting sense, and the scope of the present invention is defined by the appended claims.

In one aspect, environmental improvement systems are described herein. In some embodiments of the present invention, an environmental improvement system comprises a duct system that extends through the open volume of the room substantially from the floor of the room to the ceiling of the room. The duct system comprises a base unit at a first end of the duct system terminating proximate the floor of the room and a support unit at a second end of the duct system terminating proximate the ceiling of the room. The duct system base unit defines a first opening at the first end, and the duct system support unit defines a second opening at the second end. A duct connects the base unit to the support unit. At least one fan, which may be reversible, is disposed in the duct system between the first opening and the second opening. The fan draws air from the room into the duct system, through the duct, and discharges the air from the duct system. The first opening is adapted to selectively act as a first intake opening through which the air is drawn into the duct system by the fan or as a first discharge opening through which the air is discharged from the duct system. The second opening is adapted to selectively act as a second intake opening through which the air is drawn into the duct system by the fan or as a second discharge opening through which the air is discharged from the duct system. Thus, either the first opening or the second opening can be used as the point of entry for the air, as desired by the user. The opening not used as the point of entry can be used as the point of discharge. Additionally, at least two fans may be provided which are substantially synchronized to each deliver substantially the same volumetric airflow with respect to one another.

For example, in one embodiment of the present invention, the fan disposed in the duct system draws air from the room into the duct system through the second opening and discharges such air to the room through the first opening. Alternatively, in another embodiment of the invention, the fan disposed in the duct system draws air from the room into the duct system through the first opening and discharges such air to the room through the second opening. In addition, the fan can discharge the air vertically or substantially vertically, including towards the ceiling or the floor. For instance, in one embodiment of the present invention, the fan discharges substantially vertically towards the ceiling the air drawn into the duct system through the first opening. Further, the fan can also draw air into the duct system laterally from the room. In one embodiment of the present invention, for example, the duct system extends substantially vertically and the fan draws air laterally from the room into the duct system through the first opening or the second opening. Moreover, the duct system can be adapted to confine the conveyed air during its conveyance from the point of entry to the point of discharge from the duct system.

The duct system can have a vertical length of a variety of lengths, and in one embodiment of the present invention, the duct system extends through at least about 70% of the vertical distance between the floor and the ceiling. In addition, the vertical distance between the floor and the first end of the duct system can, in one embodiment, be no more than about 20% of the vertical distance between the floor and the ceiling, if desired. Similarly, in an embodiment of the present invention, the vertical distance between the ceiling and the second end of the duct system is no more than about 20% of the vertical distance between the floor and the ceiling. Moreover, the vertical length of the duct system can be varied as desired, perhaps seasonally, such as by altering the length of the duct of the duct system. For example, the length can be longer in cooler months and shorter in warmer months. In this way, more warm air can be conveyed to the floor region from nearer the ceiling during cooler months, while more warm air can remain near the ceiling during warmer months. Therefore, in some embodiments of the present invention, the vertical length of the duct system is adjustable.

In one embodiment of the present invention, a plurality of fans is disposed in the duct system. Use of a plurality of fans can permit "push-pull" air handling. For example, a first fan of a plurality of fans disposed in the duct system can "push" air from the room into the duct system. A second fan can "pull" the air from the duct system to discharge the air into the room. In addition, the plurality of fans can be synchronized to balance the pushing and pulling of the air flow through the duct system such that each fan is substantially synchronized to provide substantially the same volumetric airflow with respect to one another.

The duct system can also be attached or coupled to the ceiling or the floor or to both the ceiling and the floor. For example, in one embodiment of the present invention, the base unit at the first end of the duct system is placed on or attached to the floor. In another embodiment of the present invention, the support unit at the second end of the duct system is attached to the ceiling. For instance, the support unit can include a hanger for attachment of the support unit at the second end of the duct system to the ceiling.

Moreover, the duct system of an environmental improvement system described herein can omit the base unit or the support unit. In such a system, the remaining unit (e.g., the base unit) can support the duct system on its own, including by being coupled or attached to the floor or ceiling of the room. For example, in one embodiment of the present invention, the duct system comprises a base unit at a first end of the duct system terminating proximate the floor of the room and a vertically extending duct attached to the base unit and terminating at a second end of the duct system proximate the ceiling of the room. The base unit defines a first opening at the first end and can be placed on the floor of the room. The duct of the system can define a second opening at the second end.

In addition, the duct of the duct system can have any shape and cross-section not inconsistent with the objectives of the present invention. In one embodiment of the present invention, the duct has a round, square, oval, or tubular shape and/or cross-section. The shape and/or cross-section can also vary along the length of the duct.

The duct can also be constructed of any material not inconsistent with the objectives of the present invention. In one embodiment of the present invention, the duct is rigid and/or is constructed of a rigid material. Use of a rigid duct may be especially desirable in systems wherein the base unit or the support unit is omitted, as described above. Alternatively, the duct can be flexible and/or constructed of a flexible material. The duct can be constructed of one or more of plastic, fiberglass, non-woven, wood, metal, cement, and ceramic materials. In an embodiment of the present invention, the duct is constructed of a cloth or fabric material. The duct can also have a cloth or fabric exterior. Moreover, the duct can be formed in any manner not inconsistent with the objectives of the present invention. For example, in some embodiments, the duct is extruded or molded.

Further, in one embodiment of the present invention, the duct has a modular construction. A modular duct can comprise more than one section, such as a lower section, a middle section, and an upper section. The different sections can be made from the same or different materials and can have the same or different sizes and shapes. In addition, the different sections of a modular duct can be attached or coupled together in any manner not inconsistent with the objectives of the present invention, such as by rigid or flexible tubular material or by a connection flange. A modular duct can also include one or more housings disposed in one or more sections of the duct, such as one or more fan housings disposed in an upper, middle, and/or lower section of the duct. One or more sections of a modular duct can also consist essentially of a housing. Any housing not inconsistent with the objectives of the present invention may be used. A modular duct can also comprise other modular components, such as connector members and duct extension members.

Moreover, in an embodiment of the present invention, the duct can be lit and/or decorated for aesthetics and/or information purposes. For example, the duct can be decorated to provide information, to complement building decor, and/or to promote a brand and/or theme of a product and/or service.

Further, the first and second openings of the duct system can have any size and shape not inconsistent with the objectives of the present invention. In an embodiment of the present invention, for instance, the openings comprise or consist of open ends of the base and support units. One or both of the openings can also comprise or consist of an open end of the duct, such as an open end of a rigid tubular duct. The first and/or second opening can also comprise or consist of a vent. In addition, one or both openings can be equipped with a screen to prevent animals or particulate materials from entering the duct system through the opening. The screen can be placed over an opening or near an opening.

Any fan not inconsistent with the objectives of the present invention may be used in an environmental improvement system described herein. In one embodiment of the present invention, at least one fan disposed in the duct comprises a reversible fan, including a fan capable of selectively conveying air in either a "push" or a "pull" mode.

Additionally, more than one fan can be disposed in the duct system. The plurality of fans can be configured and/or synchronized to work cooperatively. When two fans are disposed in the duct system, for instance, one or both fans can comprise a reversible fan and the fans can be configured to operate cooperatively in a "push" or "pull" mode, as desired by the user depending on which direction air is desired to move through the duct system. Moreover, when a single fan is used, the environmental improvement system can further comprise a valve disposed in the duct system, such as a butterfly valve. A valve can help provide selective conveyance of air through a duct, as desired by a user. In addition, one or more fans can be disposed in the duct system in any manner not inconsistent with the objectives of the present invention. In an embodiment of the present invention, a fan is disposed in a housing and/or supported by one or more support members, mounting members, or bracket members. A fan or a fan housing can also be disposed in the base unit or the support unit.

In one embodiment of the present invention, the environmental improvement system further comprises a contaminant removal device, including a contaminant removal device disposed in the duct system. The contaminant removal device can be disposed between the first and second openings of the duct system and/or proximate one or more of such openings. Further, one or more fans of the system can be adapted to convey air through an active region of the contaminant removal device. An active region of a contaminant removal device can comprise a spatial region in which contaminant removal effects are obtained, by a configuration that provides an ozone-production zone. Any contaminant removal device not inconsistent with the objectives of the present invention may be used. For example, a contaminant removal device can comprise a germicidal device or filter. A germicidal device can be operable to reduce the amount of live bacteria, mold, mildew, fungi, and/or microorganisms or other contaminant in the air, particularly in the air that is discharged from the duct system and into the room.

In an embodiment of the present invention, the environmental improvement system further comprises a fragrance delivery configuration. A fragrance delivery configuration can provide a fragrance or aroma to air flowing through the duct system or to air in the room. In this way, a fragrance delivery configuration can be used to mask or diminish unpleasant odors or to provide pleasant smells. For example, a fragrance delivery configuration can be used to mask, cancel, or diminish odors such as those associated with smoking, rigorous athletic activities, musty furniture, or cooking. A fragrance delivery configuration can also be used to provide a fragrance or aroma that stimulates or encourages desired commercial activity, such as purchasing behavior. For example, emitting food aromas such as popcorn, pizza, bread or cookie aromas can encourage occupants of the room to purchase such foods or related items. Similarly, emitting evergreen fragrances can heighten winter holiday sentiments and senses, and emitting floral scents can encourage room occupants to purchase flowers or perfumes. Therefore, use of an environmental improvement system described herein can, in some instances increase merchandise or food sales.

Any fragrance delivery configuration not inconsistent with the objectives of the present invention may be used. For example, in an embodiment of the present invention, the fragrance delivery configuration comprises a fragrance evaporation element, a fragrance puffing element, or a fragrance emission element, continuously, intermittently, and/or on a predetermined time basis. The fragrance delivery configuration can be a separate device added to a duct system described herein. Alternatively, a fragrance delivery configuration can consist of a component of the environmental improvement system that also serves another role. For instance, in one embodiment of the present invention, the fragrance delivery configuration is a duct or protective screen of the system that incorporates a fragrance, such as an extruded duct formed from fragrance impregnated polymer pellets. Such fragrance impregnated polymer pellets can include but are not limited to fragrance impregnated polyethylene pellets available from Polyvel Inc. (Hammonton, N.J.) or International Flavors and Fragrances (New York, N.Y.). Additional non-limiting examples of fragrance delivery configurations include a wick-type device and/or atomizer device using liquid fragrance delivered directly from a reservoir and/or which flows via gravity and/or by pump to the wick-type device and/or atomizer device. Further, solid or particulate/granular fragrance could also be used in addition to or instead of liquid fragrance and could be carried on a support, in a frame and/or grate, or in some other suitable manner, such as in a scented air freshener.

In one embodiment of the present invention, the environmental improvement system further comprises one or more secondary ducts coupled to the duct system. A secondary duct can provide a source of previously heated or cooled air to the duct system. The previously heated or cooled air can be obtained from an air heating and cooling system, including an external air heating and cooling system. Alternatively, the previously heated or cooled air can be obtained from air circulating in the room in a location other than near the first or second opening of the duct system of the environmental improvement system. Air already circulating in the room can be passed through the environmental improvement system for purifying the air and/or achieving a desired air temperature distribution in the room.

In an embodiment of the present invention, the environmental improvement system further comprises a controller, such as an electronic controller. The controller can control the operation of one or more components of the environmental improvement system. Any controller not inconsistent with the objectives of the present invention may be used, and the controller may be placed in any suitable location. In one embodiment of the present invention, the controller comprises a programmable controller adapted to control one or more of fan speed, fan direction, temperature, and time of operation. The controller can also comprise a timer control.

In one embodiment of the present invention, the environmental improvement system further comprises a power supply. The power supply can provide energy to operate one or more components of the environmental improvement system. Any power supply not inconsistent with the objectives of the present invention may be used, and the power supply may be placed in any suitable location. In one embodiment of the present invention, the power supply is energized using a switch, such as a key or toggle switch.

An environmental improvement system described herein can provide one or more advantageous features. For example, the environmental improvement system can provide a more uniform air temperature distribution in the room, including a room with high ceilings, facilitating the de-stratification of air within the building. The environmental improvement system can also conserve energy and/or reduce airborne health risks. Further, the operation of the environmental improvement system can be altered seasonally or according to the desires of the user. For example, the same system can be used to convey warm air from near the ceiling of the room to near the floor, or to convey cool air from near the floor to near the ceiling, as needed or desired. In addition, the environmental improvement system can be operated continuously with the heating or cooling system of the room. Alternatively, the system can operate on a predetermined operating cycle, such as by using a controller. The environmental improvement system can also mask or dilute unpleasant odors and/or provide pleasant or other desired fragrances or aromas.

Moreover, in one embodiment of the present invention, the environmental improvement system is portable and movable from one location to another within a room. Alternatively, a system described herein may be incorporated into the structure of a room, including as part of the permanent and/or load-bearing structure of the room, including as a load-bearing column.

In one embodiment of the present invention, a method of improving the environment within a room bounded by a floor and a ceiling and having open volume from the floor to the ceiling. The method comprises placing a duct system in the room that extends through the open volume of the room substantially from the floor of the room to the ceiling of the room. A base unit is disposed at a first end of the duct system terminated proximate the floor of the room and a support unit is disposed at a second end of the duct system terminated proximate the ceiling of the room. The base unit defines a first opening at the first end of the duct system, and the support unit defines a second opening at the second end of the duct system. At least one fan is placed in the duct system between the first opening and the second opening. Air is drawn with the fan from the room into the duct system through the first opening and discharged to the room through the second opening. Alternatively, air is drawn with the fan from the room into the duct system through the second opening and discharged to the room through the first opening.

In one embodiment of the present invention, a method of improving the environment within a room further comprises altering the temperature distribution of the air of the room. For instance, the portion of air conveyed through the duct can comprise warm air collected from proximate the ceiling of the room. This warm air can be conveyed downward through the duct and discharged proximate the floor of the room. Alternatively, the portion of air can comprise cool air collected by the system from near the floor. This cool air can be conveyed upward through the duct system and discharged near the ceiling. Therefore, a method described herein can be used to convey either warm or cool air to a desired vertical location in a room. The method can also facilitate the flow of air in the room, including by providing either warm air or cool air to eye-level, according to the season or comfort level of room occupants. The method can also increase the uniformity of the air temperature distribution in the vertical dimension.

In another embodiment of the present invention, a method of improving the environment within a room further comprises providing a contaminant removal device and placing the contaminant removal device in the duct system between the first and second openings. The method further comprises reducing the amount of airborne live bacteria, mold, mildew, or microorganisms in the room using the contaminant removal device.

In yet another embodiment of the present invention, a method of improving the environment within a room further comprises providing a fragrance delivery configuration and placing the fragrance delivery configuration in the duct system. The method further comprises providing a fragrance or aroma to the room using the fragrance delivery configuration.

In one embodiment of the present invention, the method further comprises providing previously heated or cooled air to the duct system. The previously heated or cooled air can be routed through the system to provide or amplify a desired air temperature distribution. For example, previously heated air can be routed through the system downward toward the floor. Alternatively, previously cooled air can be routed through the system upward toward the ceiling, so that the cooled air may cascade downward from the ceiling. The previously heated or cooled air can be provided through one or more secondary ducts coupling the duct system to a source of previously heated or cooled air and providing communication between the duct system and the source of newly heated or cooled air. The source can be a portion of an external heating and cooling system, for instance. Alternatively, the previously heated or cooled air can be obtained from air circulating in the room in a location other than near the first or second opening of the duct system. Moreover, air already circulating in the room can be passed through the system for purifying or imparting a fragrance to the air, not necessarily for achieving a desired air temperature distribution in the room.

FIG. 1 illustrates one potential embodiment of an environmental improvement system, generally 100, constructed in accordance with the present invention. System 100 may be particularly suitable for use in rooms with higher ceiling heights. It is to be understood, however, that the present invention is not limited to the specific configuration shown in the accompanying drawings, but could take on a variety of other configurations and embodiments while still incorporating the inventive aspects of the present invention.

Environmental improvement system 100, or "system 100," comprises a duct system, generally 110. The duct system 110 extends generally vertically through the open volume V of a room. The room has a vertical distance d between the floor F and the ceiling C. The duct system 110 comprises a base unit, generally 120, at a first end, generally 130, of the duct system 110 and a support unit, generally 140, at a second end, generally 150, of the duct system 110. A duct, generally 160, connects base unit 120 and support unit 140 such that there is fluid communication flow therebetween and therethrough. A first opening, generally 132, is located at first end 130. A second opening, generally 152, is located at second end 150. In the embodiment of FIG. 1, first opening 132 consists of one or more vents in base unit 120, and second opening 152 consists of an open end of the support unit 140. However, as described herein, first and second openings 132, 152 can also have other geometries and structures. For example, first opening 132 and/or second opening 152 can also comprise an entire open end of duct 160, particularly in embodiments wherein base unit 120 or support unit 140 is omitted.

In the embodiment of FIG. 1, a first protective screen, generally 134, is disposed in duct system 110 between first opening 132 and duct 160. In addition, a second screen, generally 154, is disposed over second opening 152.

System 100 comprises a first fan, generally 170, and a second fan, generally 180, disposed within duct system 110. First fan 170 is a reversible fan and is disposed in base unit 120, near the floor end of the duct system 110. First fan 170 may be held in place by a floor fan support bracket, generally 172, which rests on and which may be attached to floor F. Base unit 120 is placed on floor F. In the embodiment of FIG. 1, base unit 120 contains first protective screen 134. Second fan 180 is a reversible fan and is disposed in support unit 140 near the end of duct system 110 proximate or close to ceiling C. Second fan 180 may be supported by a ceiling fan support bracket, generally 182. Support unit 140 contains second protective screen 154 and may be suspended from the ceiling by a ceiling mount or hanger, generally 162. Thus, in the embodiment of FIG. 1, the environmental improvement system can be attached to or supported by the floor and/or ceiling of the room. An environmental improvement system described herein can also be free-standing or self-supporting. In the embodiment of FIG. 1, base unit 120 and support unit 140 are connected by tubular duct 160. Tubular duct 160 is flexible and provides system 100 the flexibility and modularity to span the vertical distance d. A synchronous power supply, generally 190, is coupled to both base unit 120 and support unit 140. An electrical power input, generally 200, energizes a system controller, generally 210. System controller 210 can control fan speed, fan direction, and time of operation for both first and second fans, 170 and 180.

Figure 2:
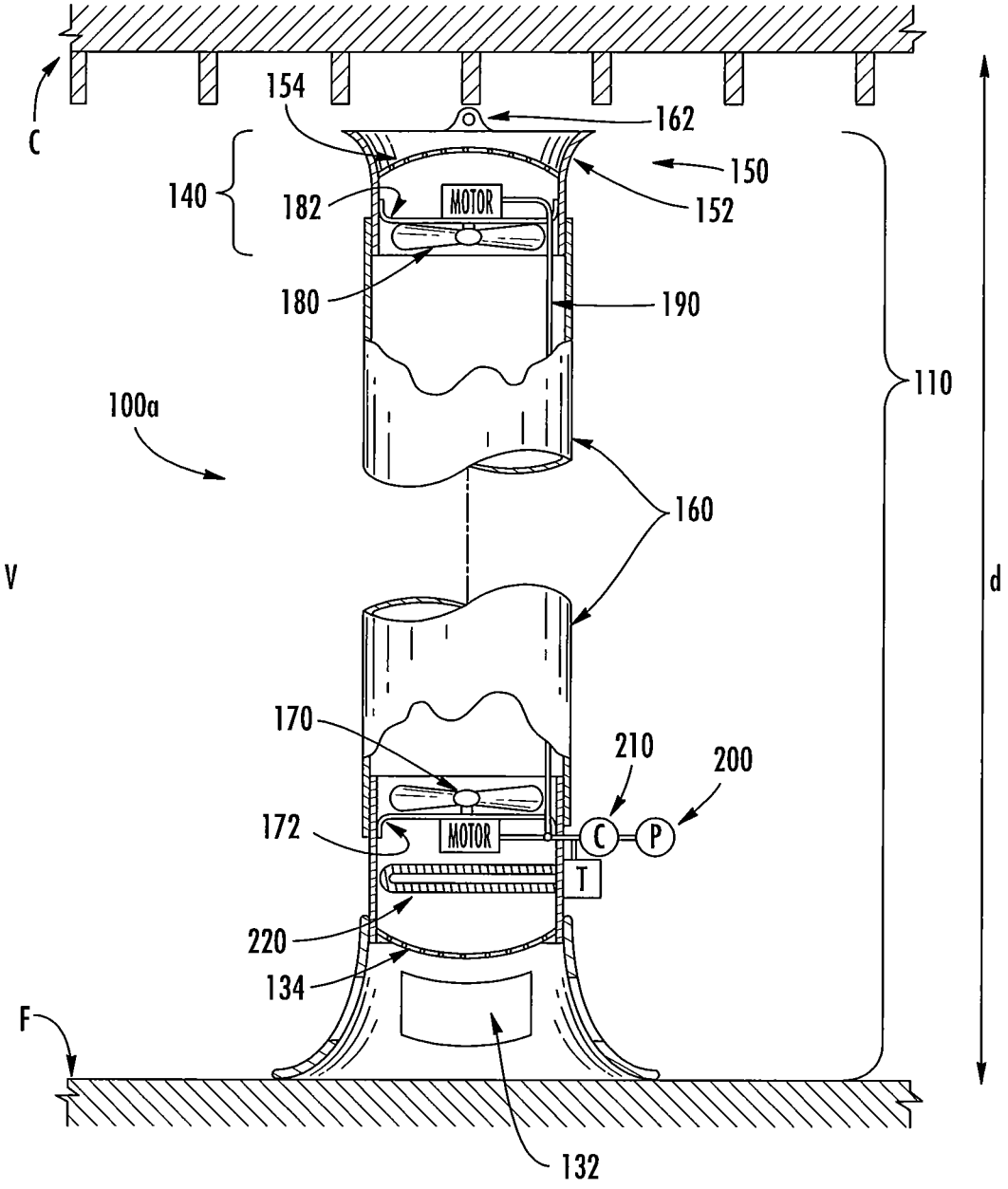
FIG. 2 is a perspective view, with parts cut away, of an environmental improvement system constructed in accordance with the present invention, illustrating the use of two synchronized push-pull reversible fans and a contaminant removal device.

FIG. 2 illustrates another embodiment of an environmental improvement system, generally 100*a*, constructed in accordance with the present invention. Environmental improvement system 100*a* is of similar construction as system 100 and further comprises a germicidal, or, contaminant removal device, generally 220. Device 220 comprises a germicidal lamp and is disposed within base unit 120. However, device 220 could also be disposed elsewhere within duct system 110 such as within support unit 140. Further, environmental improvement system 100*a*, as well as other embodiments of environmental improvement systems described herein, can freshen air by diluting or diffusing unpleasant odors. For example, an unpleasant odor such as an odor associated with smoking can be diluted in a room by passing malodorous air through duct system 110, thereby moving the air to a different portion of the room and diluting the concentration of odorous material in the room. In this way, the perceived odor in the room can be diminished. In addition, system 100*a* further comprises a fragrance delivery configuration. In the embodiment of FIG. 2, the protective screen 134 serves as the fragrance delivery configuration, as described hereinabove. However, it is to be noted that other components could also serve as a fragrance delivery configuration, such as an extruded duct 160. Moreover, it is to be noted that a separate fragrance delivery device could also be used. Such a device as described hereinabove, for instance, could be disposed within the base unit, within the duct, or elsewhere. In the embodiment of FIG. 2, the environmental improvement system comprises both a contaminant removal device and a fragrance delivery configuration. However, it is to be noted that these features and others described herein need not be present or absent in tandem. Rather, an environmental improvement system can, in one embodiment, comprise only a contaminant removal device or only a fragrance delivery configuration, as needed or desired by the user. Similarly, an environmental improvement system described herein, in another embodiment, can include neither a contaminant removal device nor a fragrance delivery configuration, as desired by the user.

Figure 3:
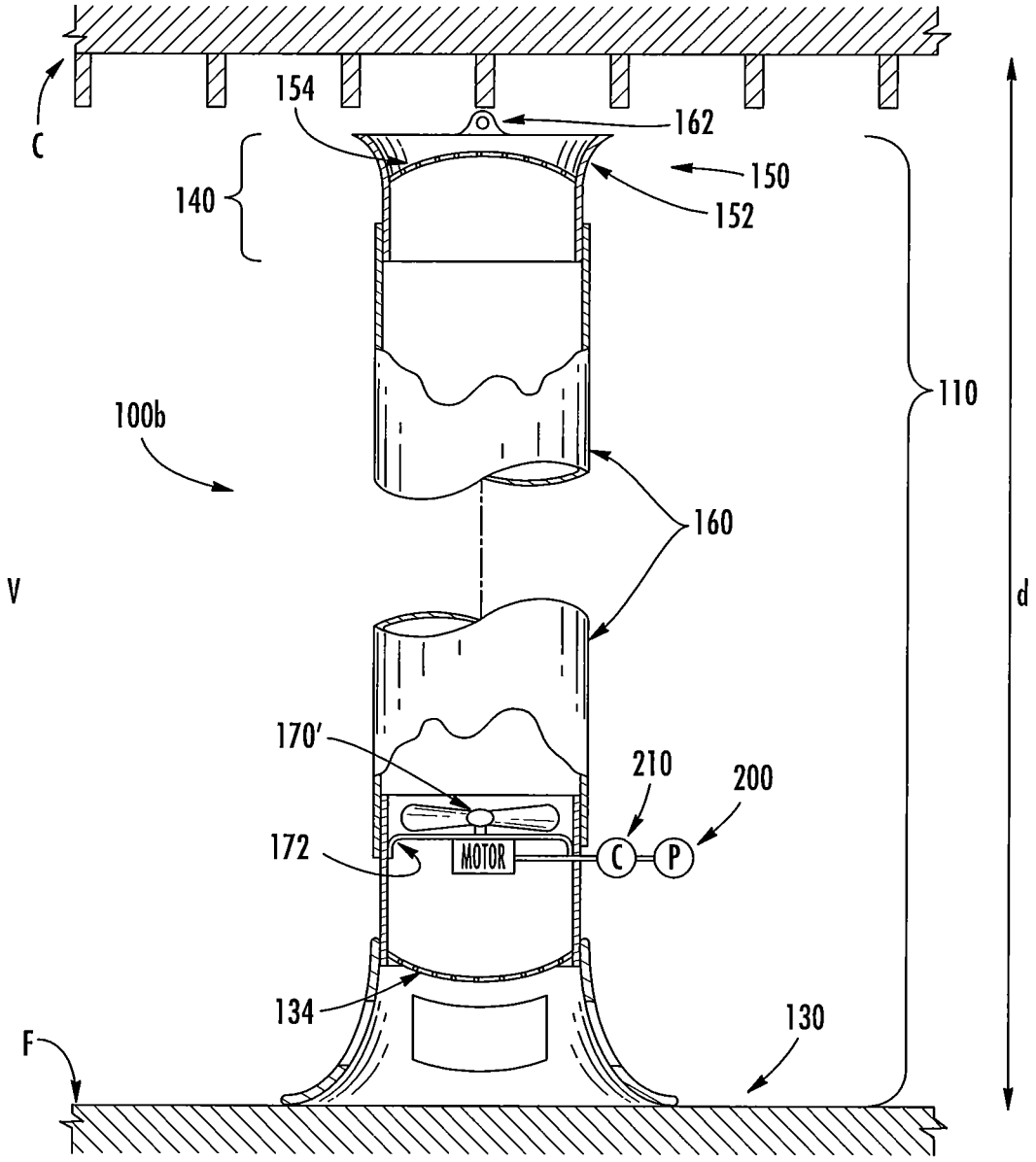
FIG. 3 is a perspective view, with parts cut away, of an environmental improvement system constructed in accordance with the present invention, illustrating the use of one reversible fan.

FIG. 3 illustrates another embodiment of an environmental improvement system 100*b*, constructed in accordance with the present invention. The embodiment of FIG. 3 may be particularly suitable for use in rooms with lower ceiling heights. Environmental improvement system 100*b* is of construction similar to environmental improvement system 100 and differs in that it includes a single fan 170' disposed within duct system 110. In the embodiment of FIG. 3, fan 170' is a reversible fan and is disposed near the floor end of the duct system 110. Alternatively, however, fan 170' could be mounted near the ceiling end of the duct system 110. Fan 170' may be held in place by a floor fan support bracket 172 and disposed in base unit 120. In addition, like system 100 or 100*a*, system 100*b* can be attached to or supported by the floor and/or ceiling if desired, as opposed to being free-standing or self-supporting.

Figure 4:
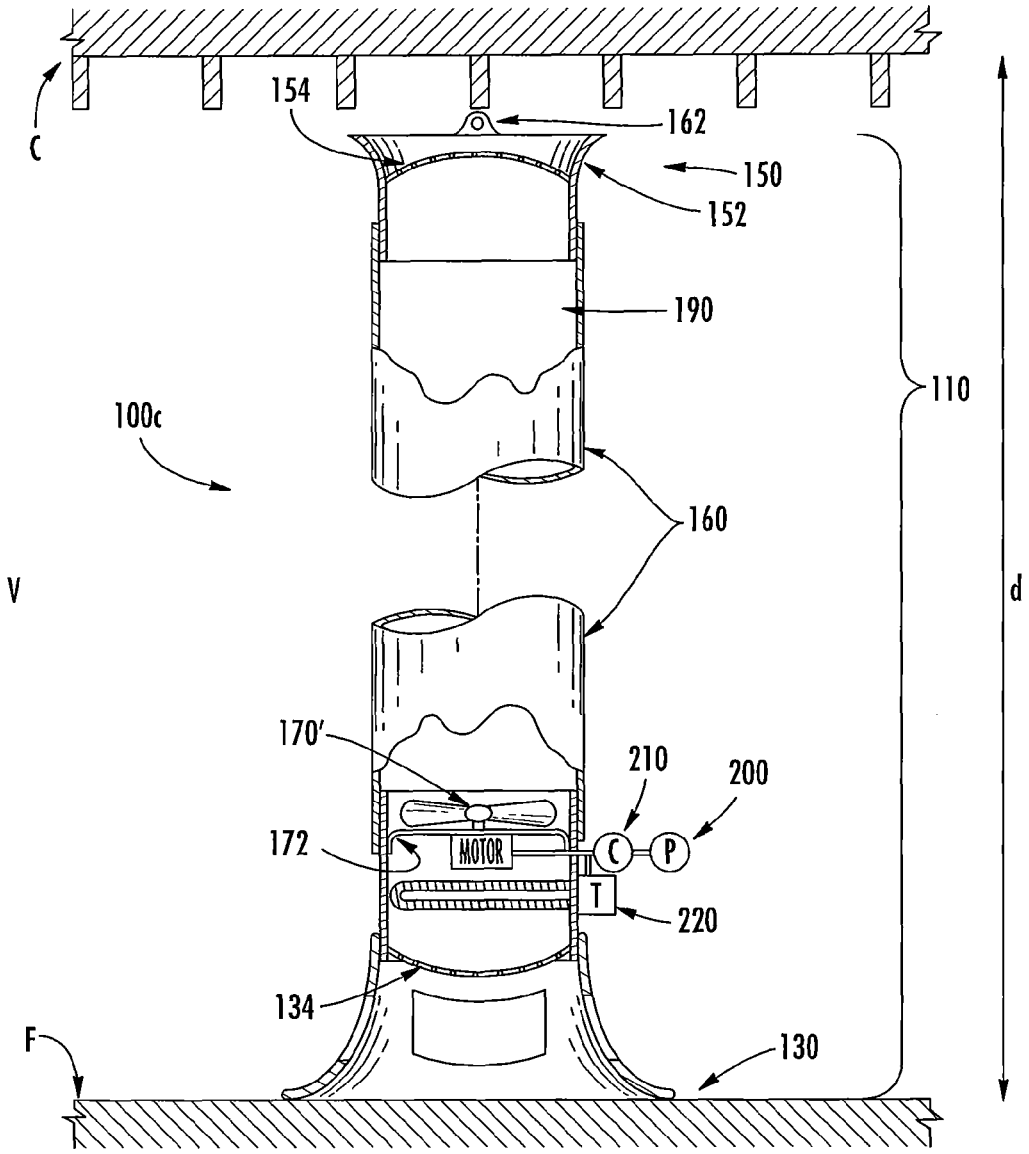
FIG. 4 is a perspective view, with parts cut away, of an environmental improvement system constructed in accordance with the present invention, illustrating the use of one reversible fan and a contaminant removal device.

FIG. 4 illustrates another embodiment of an environmental improvement system, generally 100*c*, constructed in accordance with the present invention, and may be particularly suitable for use in rooms with lower ceiling heights. Environmental improvement system 100*c* is of similar construction as environmental system 100*b* and further includes a contaminant removal device 220, as discussed above. It is to be noted that device 220 could also be disposed elsewhere within duct system 110, other than as shown in FIG. 4, such as within support unit 140 or elsewhere. In addition, system 100*c* further comprises a fragrance delivery configuration. In the embodiment of FIG. 4, the duct 160 is an extruded duct formed from a fragrance impregnated polymer, thus serving as the fragrance delivery configuration. In the embodiment of FIG. 4, the environmental improvement system comprises both a contaminant removal device and a fragrance delivery configuration. However, it is to be noted that these features and others described herein need not be present or absent in tandem, as described above.

Figure 5:
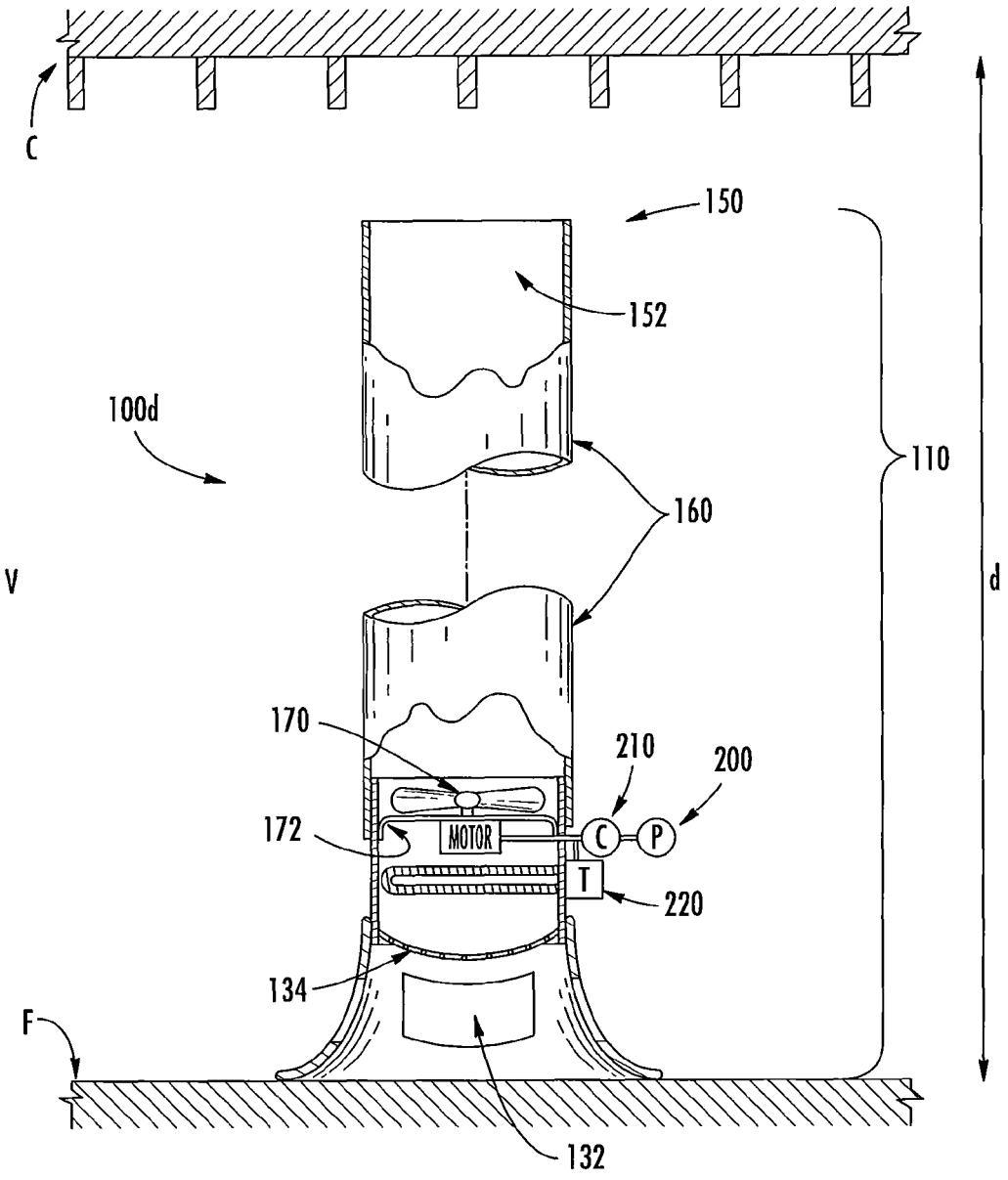
FIG. 5 is a perspective view, with parts cut away, of an environmental improvement system constructed in accordance with the present invention, illustrating the use of one reversible fan and a rigid duct.

FIG. 5 illustrates another embodiment of an environmental improvement system, generally 100*d*, constructed in accordance with the present invention. Environmental improvement system 100*d* is of similar construction as environmental system 100*b*, except system 100*d* does not include support unit 140. Instead, duct system 110 of system 100*d* is supported by base unit 120. Duct 160 is rigid, and duct system 110 may have an overall vertical height of about 10 to 15 feet. Therefore, system 100*d* can be self-supporting or free-standing. The environmental improvement system 100*d* may thus advantageously be used in a room having lower ceiling heights and/or a room or building having a high occupant density, such as a school or a hospital.

While several embodiments have been described in detail herein, it will be apparent to those skilled in the art that the disclosed embodiments may be modified. Therefore, the foregoing descriptions are to be considered exemplary and are not intended to limit the invention to these embodiments. On the contrary, the invention is intended to cover alternatives, modifications and equivalents, which may be included within the spirit and scope of the invention as defined by the appended claims.

Furthermore, in the detailed description of the present invention, numerous specific details are set forth in order to provide a thorough understanding of the present invention. In other instances, well-known methods, procedures, components, and configurations have not been described in detail as not to unnecessarily obscure aspects of the present invention. However, it will be recognized by one of ordinary skill in the art that the present invention may be practiced without these specific details.

What is claimed is:

1. An environmental improvement system for placement within a room bounded by a floor and a ceiling and having an open volume from the floor to the ceiling, the environmental improvement system comprising:

a duct system that extends through the open volume of the room substantially from the floor of the room to the ceiling of the room;

said duct system comprising a base unit at a first end of said duct system terminating proximate the floor of the room, a support unit at a second end of said duct system terminating proximate the ceiling of the room, and a duct connecting said base unit to said support unit;

said base unit defining a first opening at said first end;

said support unit defining a second opening at said second end;

at least one reversible fan disposed in said duct system between said first opening and said second opening that draws air from the room into said duct system, through said duct, and discharges said air from said duct system, wherein the reversible fan is configured to selectively convey air in a first direction and a second direction in either a push or a pull mode;

said first opening being adapted to selectively act as a first intake opening through which said air is drawn into said duct system by said fan or as a first discharge opening through which said air is discharged from said duct system; and said second opening being adapted to selectively act as a second intake opening through which said air is drawn into said duct system by said fan or as a second discharge opening through which said air is discharged from said duct system, wherein a first protective screen is disposed in said duct system proximate said first opening and between said duct and said open volume of said room, and wherein a second protective screen is disposed in said duct system proximate said second opening and between said duct and said open volume of said room, at least one of the first protective screen and the second protective screen incorporating a fragrance.

2. The system defined by claim 1, wherein said support unit is attached to said ceiling.

3. The system defined by claim 1, wherein said support unit includes a hanger for attachment of said support unit to said ceiling.

4. The system defined by claim 1, further comprising:

said base unit being placed on said floor; and said support unit including a hanger for attachment of said support unit to said ceiling.

5. The system defined by claim 1, further comprising:

said base unit being placed on said floor;

said support unit including a hanger for attachment of said support unit to said ceiling; and a contaminant removal device disposed in said duct system between said first opening and said second opening.

6. An environmental improvement system for placement within a room bounded by a floor and a ceiling and having an open volume from the floor to the ceiling, the environmental improvement system comprising:

a duct system that extends through the open volume of the room substantially from the floor of the room to the ceiling of the room;

said duct system comprising a base unit at a first end of said duct system terminating proximate the floor of the room, a support unit at a second end of said duct system terminating proximate the ceiling of the room, and a duct connecting said base unit to said support unit;

said base unit defining a first opening at said first end;

said support unit defining a second opening at said second end; and a plurality of fans disposed in said duct system between said first opening and said second opening that selectively draws air from the room into said duct system through said second opening and discharges such air to said room through said first opening and that selectively draws air from the room into said duct system through said first opening and discharges such air to said room through said second opening, wherein said plurality of fans includes a first fan configured to push air from the room into said duct system and a second fan configured to pull air from said duct system and to discharge the air into the room;

wherein the first fan and the second fan are arranged in series;

wherein said first fan and said second fan are substantially synchronized to each provide substantially the same volumetric airflow with respect to one another and wherein at least one of said first and second fans comprises a reversible fan, the first fan and the second fan being synchronized by a system controller that can control one or more of fan speed, fan direction, and time of operation for both the first and second fans; and wherein a first protective screen is disposed in said duct system proximate said first opening and between said duct and said open volume of said room, and wherein a second protective screen is disposed in said duct system proximate said second opening and between said duct and said open volume of said room.

7. The system defined by claim 6, wherein said support unit is attached to said ceiling.

8. The system defined by claim 6, wherein said support unit includes a hanger for attachment of said support unit to said ceiling.

9. The system defined by claim 6, further comprising:

said base unit being placed on said floor; and said support unit including a hanger for attachment of said support unit to said ceiling.

10. The system defined by claim 6, further comprising:

said base unit being placed on said floor;

said support unit including a hanger for attachment of said support unit to said ceiling;

a contaminant removal device disposed in said duct system between said first opening and said second opening; and a scented protective screen that provides a fragrance to cancel odors in the air drawn from the room.

11. An environmental improvement system for placement within a room bounded by a floor and a ceiling and having open volume from the floor to the ceiling, the environmental improvement system comprising:

a duct system that extends through the open volume of the room substantially from the floor of the room to the ceiling of the room;

said duct system comprising a base unit at a first end of said duct system terminating proximate the floor of the room and a substantially vertically extending duct attached to said base unit and terminating at a second end of said duct system proximate the ceiling of the room;

said base unit defining a first opening at said first end;

said duct defining a second opening at said second end;

at least one reversible fan disposed in said duct system between said first opening and said second opening that draws air from the room into said duct system, through said duct, and discharges said air from said duct system, wherein the reversible fan is configured to selectively convey air in a first direction and a second direction in either a push or a pull mode;

said first opening being adapted to selectively act as a first intake opening through which said air is drawn into said duct system by said fan or as a first discharge opening through which said air is discharged from said duct system; and said second opening being adapted to selectively act as a second intake opening through which said air is drawn into said duct system by said fan or as a second discharge opening through which said air is discharged from said duct system, wherein a first protective screen is disposed in said duct system proximate said first opening and between said duct and said open volume of said room, and wherein a second protective screen is disposed in said duct system proximate said second opening and between said duct and said open volume of said room, at least one of the first protective screen and the second protective screen incorporating a fragrance.

12. The system defined by claim 11, wherein said base unit is placed on said floor.

13. The system defined by claim 11, further comprising a contaminant removal device disposed in said duct system between said first opening and said second opening.

14. The system defined by claim 13, wherein said contaminant removal device comprises an ozone-producing device.

15. The system defined by claim 13, wherein said system is configured to reduce the amount of airborne live bacteria, mold, mildew, or microorganisms in said room using said contaminant removal device.

16. The system defined by claim 11, further comprising a fragrance delivery configuration.

17. The system defined by claim 16, wherein said fragrance delivery configuration emits a fragrance to cancel odors.

18. The system defined by claim 16, wherein said fragrance delivery configuration emits an aroma to stimulate commercial activity.

19. The system defined by claim 11, further comprising a controller that controls the direction and time of operation of said fan.

20. The system defined by claim 11, wherein said duct includes decorative features for aesthetic or information purposes.

* * * * *